US008281862B2

(12) United States Patent
Barber et al.

(10) Patent No.: US 8,281,862 B2
(45) Date of Patent: Oct. 9, 2012

(54) TESTING SUBSEA UMBILICALS

(75) Inventors: Robert I. Barber, Ely (GB); Alan C. Clunie, Locheamhead (GB)

(73) Assignee: Halliburton Energy Services Inc., Duncan, OK (US)

( * ) Notice: Subject to any disclaimer, the term of this patent is extended or adjusted under 35 U.S.C. 154(b) by 227 days.

(21) Appl. No.: 12/762,173

(22) Filed: Apr. 16, 2010

(65) Prior Publication Data

US 2011/0253377 A1 Oct. 20, 2011

(51) Int. Cl.
*E21B 7/12* (2006.01)

(52) U.S. Cl. .... 166/336; 166/335; 166/338; 166/250.17

(58) Field of Classification Search ..... 166/336, 166/337, 338, 250.01
See application file for complete search history.

(56) References Cited

U.S. PATENT DOCUMENTS

| | | | | |
|---|---|---|---|---|
| 5,593,249 | A * | 1/1997 | Cox et al. | 405/191 |
| 5,730,551 | A * | 3/1998 | Skeels et al. | 405/170 |
| 5,927,901 | A | 7/1999 | Graves | |
| 6,446,720 | B1 * | 9/2002 | Ringgenberg et al. | 166/250.17 |
| 6,644,410 | B1 * | 11/2003 | Lindsey-Curran et al. | 166/360 |
| 6,840,088 | B2 | 1/2005 | Tucker et al. | |
| 7,137,451 | B2 * | 11/2006 | Smith | 166/335 |
| 7,281,880 | B2 | 10/2007 | Tucker et al. | |
| 7,513,308 | B2 * | 4/2009 | Hosie et al. | 166/338 |
| 2002/0129641 | A1 | 9/2002 | Tucker et al. | |
| 2003/0010094 | A1 | 1/2003 | Tucker et al. | |
| 2003/0154769 | A1 | 8/2003 | Tucker et al. | |
| 2004/0069492 | A1 * | 4/2004 | Smith | 166/336 |
| 2006/0083624 | A1 | 4/2006 | Cunningham et al. | |
| 2008/0282776 | A1 | 11/2008 | Loeb et al. | |
| 2008/0282777 | A1 | 11/2008 | Loeb | |
| 2009/0288836 | A1 | 11/2009 | Goodall et al. | |
| 2010/0085064 | A1 * | 4/2010 | Loeb et al. | 324/537 |
| 2010/0089126 | A1 * | 4/2010 | Sweeney | 73/40 |
| 2011/0198092 | A1 * | 8/2011 | Machin et al. | 166/349 |

FOREIGN PATENT DOCUMENTS

| | | | |
|---|---|---|---|
| EP | 2 003 285 | A1 | 12/2008 |
| GB | 2 390 435 | A | 1/2004 |
| GB | 2 390 435 | B | 9/2005 |
| GB | 2 457 888 | A | 9/2009 |
| GB | 2 460 170 | A | 11/2009 |
| WO | 2008/144338 | A1 | 11/2008 |

OTHER PUBLICATIONS

Notification of Transmittal of the International Search Report and the Written Opinion of the International Searching Authority, or Declaration (1 page); International Search Report (5 pages); and Written Opinion of the International Searching Authority (7 pages), mailed Jul. 27, 2011, for PCT/GB2011/000592.

* cited by examiner

*Primary Examiner* — Thomas Beach
*Assistant Examiner* — Aaron Lembo
(74) *Attorney, Agent, or Firm* — John W. Wustenberg; Fish & Richardson, P.C.

(57) ABSTRACT

An aspect encompasses a method of testing a subsea umbilical where a first portion of testing is performed on the subsea umbilical, the testing comprising hydraulic testing and at least one of electrical or optical testing, and a second portion of the testing is performed independent of a diver or an ROV.

20 Claims, 6 Drawing Sheets

TESTING SUBSEA UMBILICALS

BACKGROUND

This specification relates to subsea control systems.

Subsea wellheads or trees can be operated remotely using control conduits, called umbilicals, that convey control signals, data, and operating and control fluids. In some scenarios, the functional components of subsea control systems can include umbilicals, flying leads, control modules, and the like. The functionality and integrity of the control systems can be tested to verify proper operation prior to being placed into service.

SUMMARY

This specification describes technologies relating to testing subsea umbilicals.

An aspect encompasses a method of testing a subsea umbilical. In the method, at least one of electric or optical testing is initiated on the subsea umbilical is performed using an umbilical testing skid residing subsea and coupled to communicate hydraulically with the subsea umbilical and at least one of electrically or optically with the subsea umbilical. Hydraulic testing is initiated on the subsea umbilical using the umbilical testing skid. Substantially the remainder of the hydraulic testing is performed with the testing skid not coupled to an ROV.

An aspect encompasses a system for testing a subsea umbilical. The test skid includes a hydraulic testing unit for hydraulic testing the subsea umbilical, an electrical testing unit for performing electrical testing on the subsea umbilical, and an optical fiber testing unit for performing optical fiber testing on the subsea umbilical. An umbilical coupling is in communication with the hydraulic testing unit, the electrical testing unit, and the optical fiber testing unit for communicating, apart from an ROV, between the hydraulic testing unit, the electrical testing unit, and the optical fiber testing unit and a human machine interface. A test lead coupling is provided for coupling the hydraulic testing unit, the electrical testing unit, and the optical fiber testing unit to the subsea umbilical being tested.

An aspect encompasses a method of testing a subsea umbilical where a first portion of testing is performed on the subsea umbilical, the testing comprising hydraulic testing and at least one of electrical or optical testing, and a second portion of the testing is performed independent of a diver or an ROV.

Particular implementations of the subject matter described in this specification can be implemented so as to realize one or more of the following potential advantages. The subsea umbilical test skid described here can be a stand-alone unit that can be left on the seabed, for example, for over twenty four hours. The skid can be left on the seabed even after the skid has performed a portion of the testing, for example, electrical and fiber testing, to continue logging test data. The tests can include hydraulic testing including pressure tests to measure leakage in pressurized umbilicals. The skid can perform the pressure tests for extended durations, for example, one to twenty four hours or longer and log test data during this time while being unattended by a diver or remote operating vehicle (ROV). The ability to operate unattended, apart from an ROV or a diver, can in certain instances result in potential savings of several days of attending vessel time and remote operating vehicle (ROV) attendance hours. Tests such as time domain reflectometry (TDR), optical time domain reflectometry (OTDR), and the like, can be performed remotely. Further, the components on the skid, for example, hydraulic pumps and intensifiers, can also be remotely controlled. Furthermore, the skid can be self-contained such that all fluids and pumps are on board the skid with a control umbilical, used to control the testing units of the skid, provide power to the testing units of the skid, and/or collect data from the skid, being the only component external to the skid.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This specification describes a self-contained subsea test skid that can provide a testing solution for one or more umbilicals, for example, electro-, hydraulic-, fiber-umbilicals, and the like. As described below, the subsea test skid, that resides subsea, can be coupled hydraulically to the subsea umbilical and can be used to hydraulically test the subsea umbilical. The test skid and the subsea umbilical can additionally or alternatively be coupled electrically or optically or both.

The following acronyms are used with for convenience of reference when describing the skid and its surroundings.

| | |
|---|---|
| CR | Conductor Resistance |
| DWUTS | Deep Water Umbilical Test Skid |
| FPSO | Floating Production, Storage, and Off-loading |
| HMI | Human Machine Interface |
| IR | Insulation Resistance |
| OTDR | Optical Time Domain Reflectometry |
| PLC | Programmable Logic Controller |
| ROV | Remote Operated Vehicle, also often referred to as a subsea vehicle or automated underwater vehicle |
| SUTA | Subsea Umbilical Termination Assembly |
| TDR | Time Domain Reflectometry |
| USB | Universal Serial Bus |

Figure 1:
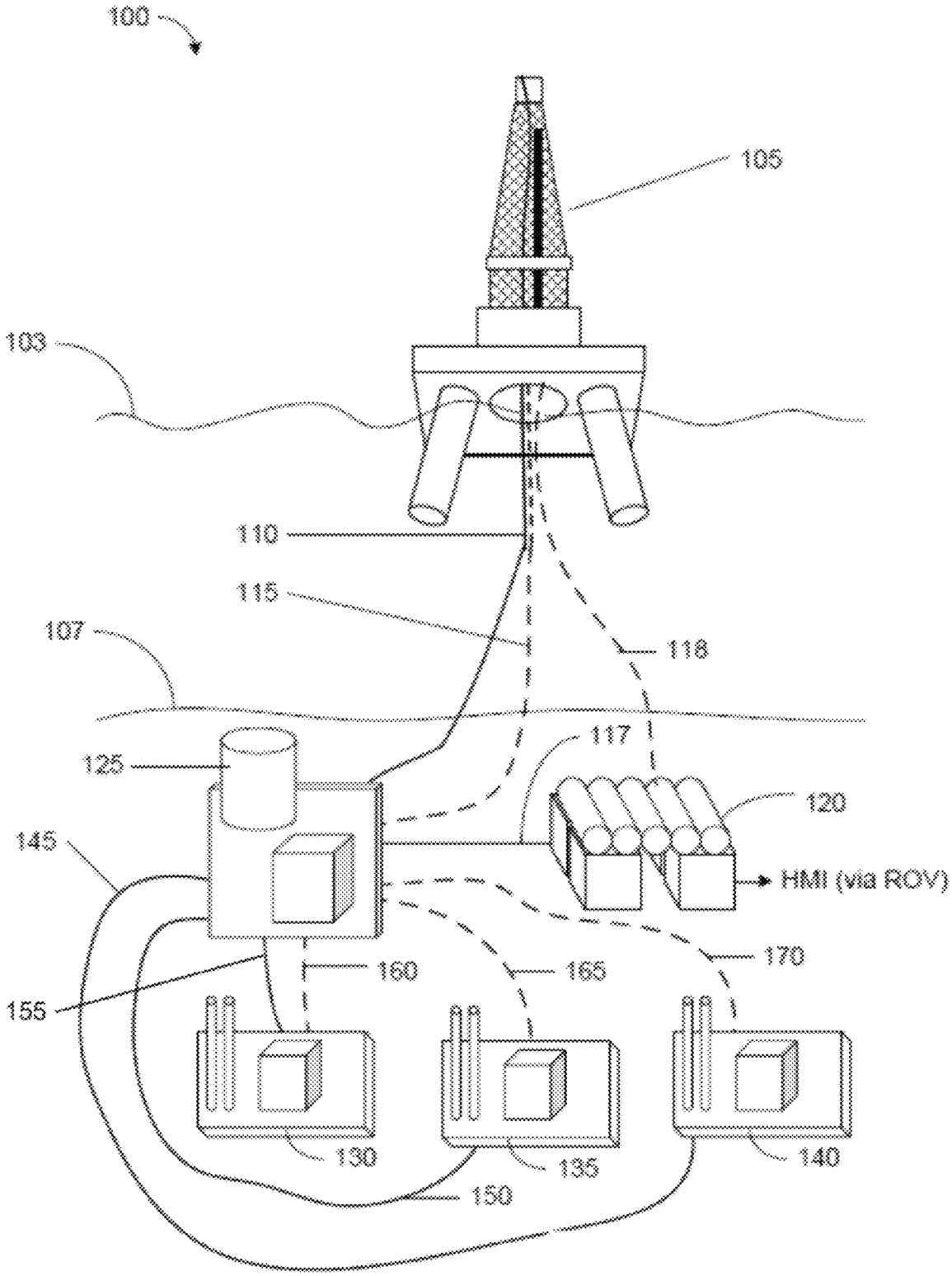
FIG. 1 is a schematic diagram showing a subsea production facility.

FIG. 1 is a schematic diagram showing a subsea production facility 100. As described below, the subsea production facility 100 includes the DWUTS 120 that can be lowered to a location near an umbilical end termination, for example, the SUTA on skid 125, on the seabed 107. In some implementations, the subsea production facility 100 can include a platform 105 to which one or more production risers 110 and umbilicals 115 can be operatively coupled. The production risers and umbilicals can run from the platform 105 (or FPSO) at sea level 103 to a manifold and SUTA, respectively, on skid 125 at seafloor 107. The manifold on skid 125 can include control modules with which the manifold can be controlled. Satellite wells, each having production trees, for example, tree 130, tree 135, and tree 140, can be operatively coupled to the manifold by umbilicals 160, 165, 170. Production lines 145, 150, and 155 can transport production (i.e., reservoir fluids), from the satellite wells (i.e., trees 130, 135, 140) to the manifold and the production riser 110 can transport the production from the manifold to the platform 105.

While the production lines can transport production, the umbilicals can transport electric power, control signals, hydraulic control fluids, and the like between the trees 130, 135, and 140, the SUTA on skid 125 and the platform 105. In some implementations, an umbilical 118 operatively couples the platform 105 and the DWUTS 120 that is configured to perform tests described below. As described later, the DWUTS 120 can be operatively coupled to the SUTA via one or more test leads 117 (similar to a subsea umbilical) and to a HMI through umbilical 118 or through an ROV (which has its own umbilical). The test leads 117 can be configured to transport fluids and communicate data, testing, and control signals between the DWUTS 120 and the umbilicals 115, 160, 165, and 170 via the SUTA. Using the HMI, an operator can control the DWUTS 120 to perform testing on the umbilicals 115, 160, 165, and 170. The testing can include one or more or all of hydraulic testing, electrical testing and/or optical testing. In some scenarios, initiating one or more of the hydraulic testing, electrical testing and/or the optical testing can employ an ROV or a diver.

The umbilicals 160, 165, and 170 are, for example, static umbilicals that couple the DWUTS 120 and the production trees 130, 135, and 140, respectively. As described with reference to FIG. 2, the umbilicals can be tested in their final position on the seabed 107 utilizing the DWUTS 120.

In certain instances, the DWUTS 120 can be left unattended, without and apart from an ROV or diver, while some or all of the testing is performed. In some instances, once testing has been initiated, the DWUTS 120 can be left unattended and can be operate to log test data and/or complete one or more tests without and apart from a coupled or attendant ROV, attendant diver or control vessel. In some scenarios, an ROV, that is initially coupled to or attendant to the DWUTS 120, can initiate testing (one or more tests and/or a sequence of tests) utilizing the DWUTS 120 and/or can remain and assist in performing a portion of the testing. Prior to performing another portion or the remainder of the testing, the ROV can be uncoupled from and/or leave the DWUTS 120 and fly off. The DWUTS 120 can then perform a portion or the remainder of the testing without or apart from the ROV. In certain instances, the ROV can be coupled to or attendant to the DWUTS 120 while some testing is initiated and completed and other testing is initiated but not completed. For example, the ROV may be coupled to or attendant to the DWUTS 120 while the hydraulic testing is initiated and electric and/or optical testing is initiated, and while the electric and/or optical testing is completed, but leave before the hydraulic testing is completed. The remainder of the hydraulic testing would then be completed without the ROV. Similarly, in scenarios in which a diver initiates the DWUTS 120 to perform testing, the diver can leave the DWUTS 120 unattended after the initiating, and the DWUTS 120 can perform a portion or the remainder of the testing unattended. In the context of hydraulic pressure testing, in certain instances, initiating may include flushing and pressurizing the umbilical with test liquid or gas and/or other initiating. The ROV and/or diver may leave while the leakdown of testing fluid is logged over a period of one to 24 hours or longer.

Once the desired testing has been completed, or at another time, the DWUTS 120 can be retrieved to the surface or used in other operations.

Figure 2:
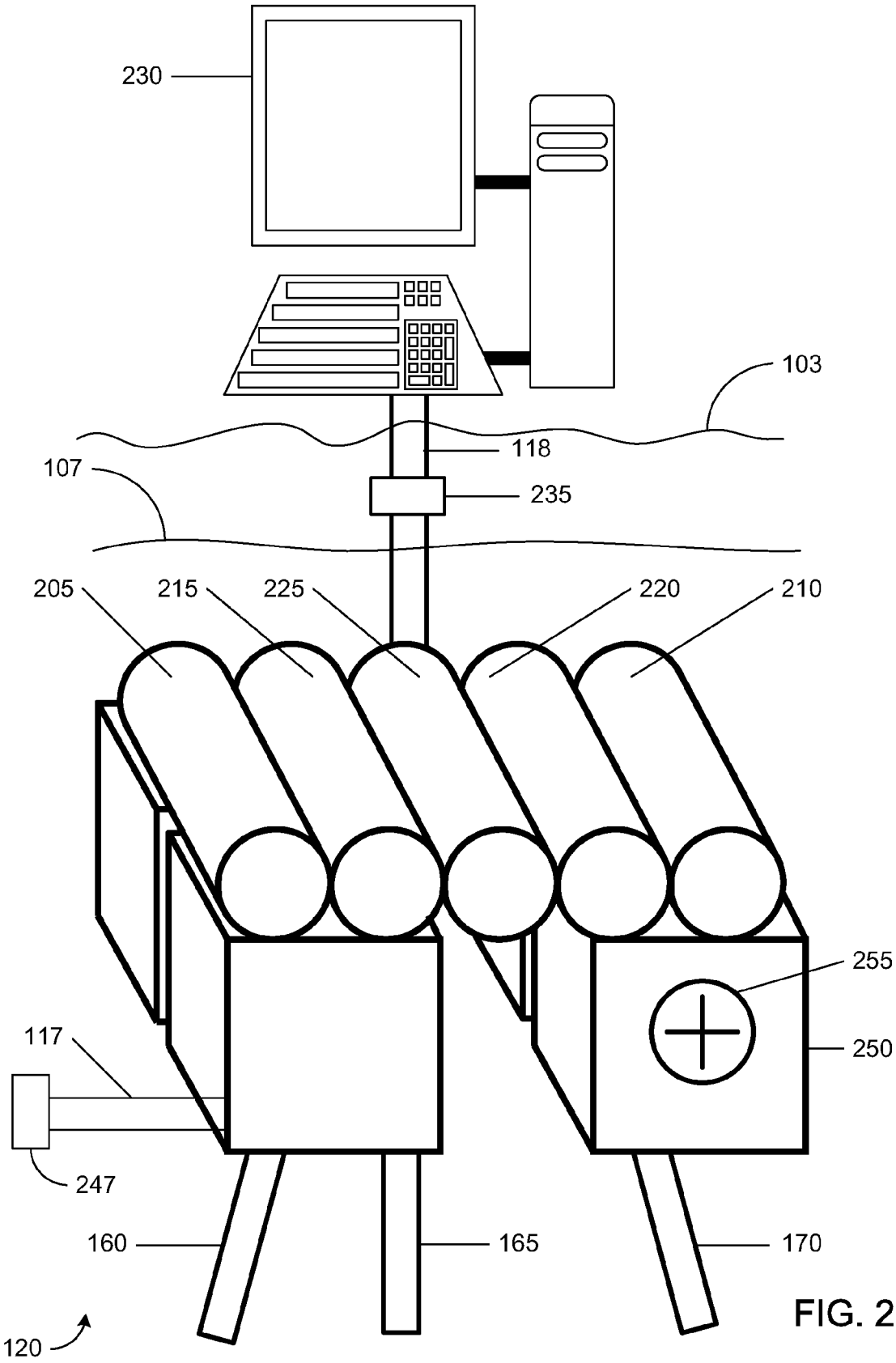
FIG. 2 is a schematic diagram showing a subsea umbilical test skid operatively coupled to a human machine interface.

FIG. 2 is a schematic diagram showing a subsea umbilical test skid (DWUTS 120) operatively coupled to a human machine interface (HMI) 230. The DWUTS 120 includes multiple components, including one or more of: a hydraulic testing unit 210 having pumps, motors and intensifiers, and configured to perform pressure, flow tests, and the like; an electrical testing unit 215 configured to perform IR, CR, TDR tests, and the like, or an optical fiber test unit 220 configured to perform OTDR tests, and the like; or a power supply 205 (e.g., battery). The DWUTS 120 further includes a data logger 225 that can be operatively coupled to one, some or all of the test units and can be configured to receive and store the data measured by the test units. In some implementations, the data logger 225 can include computer-readable and computer-searchable data storage devices, for example, hard disks, and the like, on which the data logger 225 can store the measured data. For example, the umbilical 115, 160, 165, and 170 and the testing units are coupled to transmit testing data and signals between each other. The data logger 225 can receive the test data and signals, and in some implementations, additionally process and store the test data and signals.

The umbilical 118 between the DWUTS 120 and HMI 230 can connect at an umbilical coupling 235 that communicates between the testing units installed on the DWUTS 120 and the HMI 230. In some implementations, the umbilical 118 that couples the umbilical coupling 235 and the HMI 230 can be adapted to communicate power, data, and control signals with the DWUTS 120. The HMI 230 can be located topside, for example, on or adjacent to the platform 105. Alternatively, the HMI 230 can be at a location that is separate from the platform 105, for example, on another vessel. Power and/or control signals can be transmitted to the DWUTS 120, for example, from the HMI 230 and/or from other sources, through the umbilical 118. In some implementations, an ROV operatively couples the HMI 230 to the DWUTS 120, providing power and/or control.

The HMI 230 can be configured to transmit instructions to the DWUTS 120 through the umbilical 118 to cause the test units on the DWUTS 120 to perform tests, for example, on the umbilical 115, the production trees, and the like. The DWUTS 120 can execute the tests and continue to operate the testing and/or log testing data without and apart from the ROV. Further, the HMI 230 can be operatively coupled to the data logger 225 such that the data and the signals that the data logger 225 collects are transmitted to the HMI 230 via the umbilical 118. In some implementations, the HMI 230 can be a computer system including one or more computers with memory, configured to execute computer software instructions stored on the memory that cause the computer to perform operations. The operations can include initializing the DWUTS 120 to perform tests on the production trees and to gather data.

The DWUTS 120 further includes chambers 250, each of which includes bladders and housings. The bladders are full of fluids (e.g., test fluids) when the DWUTS 120 is deployed on the seabed 107. The hydraulic test unit 210 of the DWUTS 120 further includes a pump 255 (or pumps) for flushing and/or pressurizing the umbilicals to test pressure. The hydraulic test unit 210 can also include a manifold for switching the unit 210 between multiple hydraulic lines of an umbilical, enabling a given hydraulic test unit to test multiple hydraulic lines. In some implementations, the DWUTS 120 can initiate hydraulic testing on the umbilicals by hydraulically pressurizing the umbilical with fluid in the bladders and housings. Subsequently, the hydraulic testing unit 210 can test the umbilical for leakage. In some implementations, the pump 255 can be a piston type positive displacement type. Alternatively, or in addition, the pumps can be pressure compensated radial piston pumps or opposed double acting piston type pumps or combinations of them. To pressurize the umbilical, the pump 255 can draw fluids from the bladders in the chambers 250 and pump the fluids to the umbilicals through the test leads 117. To do so, the test leads 117 can be operatively coupled to the manifold through an test lead coupling 247 that is adapted to couple to the manifold on skid 125. The chambers 250 can be re-charged upon return to the surface, i.e., filled with cleaned and certified test fluid. As described previously, the DWUTS 120 can perform substantially the remainder of the hydraulic testing while not being coupled to the ROV. The remainder of the testing can include testing the umbilical for any leakage for the duration that the umbilical has been pressurized and that the DWUTS 120 is on the seabed 107 executing tests.

Figure 3:
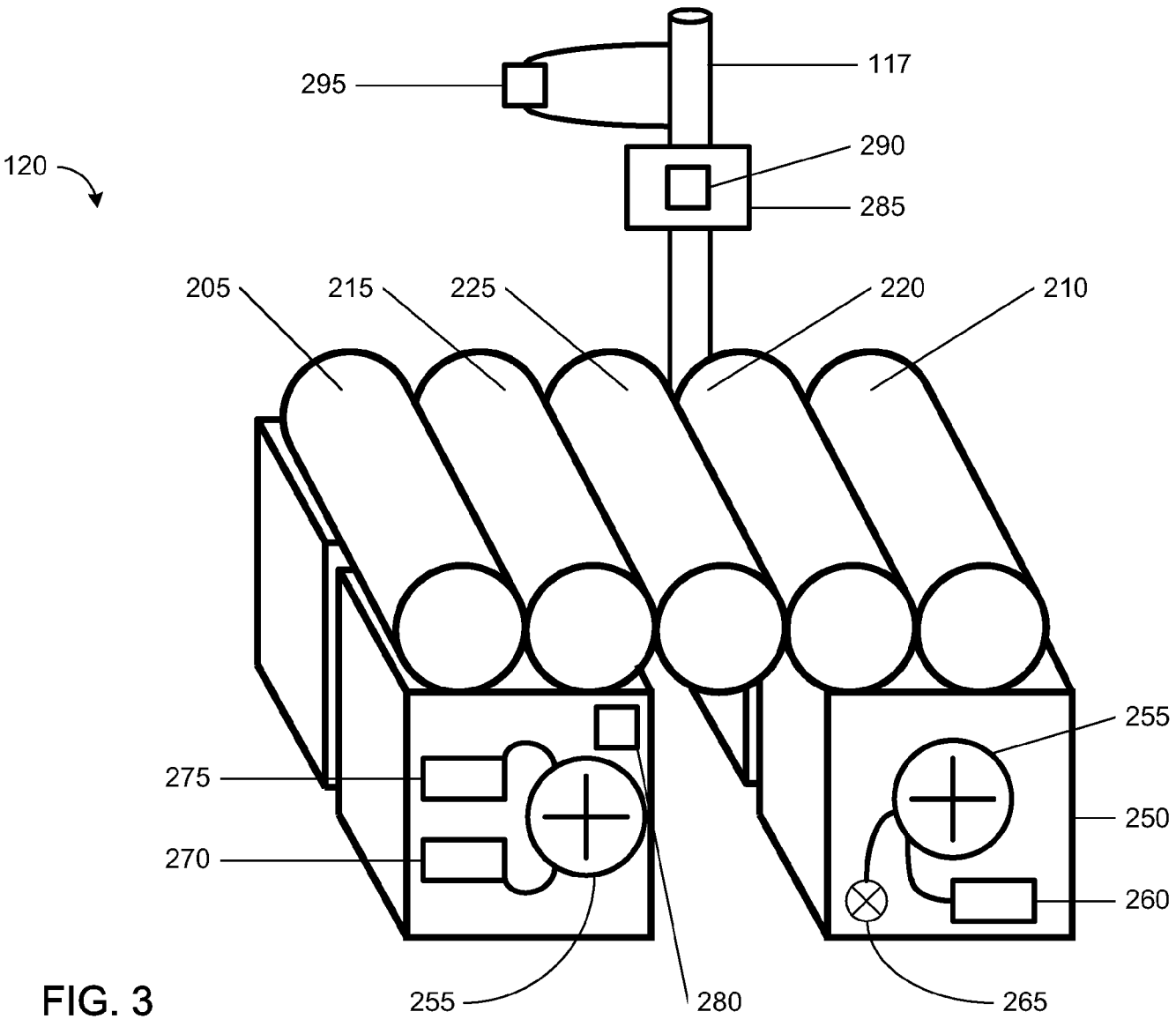
FIG. 3 is a schematic diagram showing a hydraulic system of the subsea umbilical test skid.

FIG. 3 is a schematic diagram showing a hydraulic test unit of the subsea umbilical test skid (DWUTS 120). In some implementations, the chamber 250 can be a seawater compensated tank in which test fluid is stored. For example, the chamber 250 can include a thin membrane-like container that can separate the fluid from the seawater. The DWUTS 120 can include an onboard filtration system 260 that can be operatively coupled to the pump 255 that can pull the fluid. Power for the pump 255 can be, for example, a direct hydraulic supply from an attendant ROV. Alternatively, or in addition, the power can be from a power and control line in the umbilical 118 and/or the onboard power supply 205. A control valve 265 (or multiple control valves), included in the DWUTS 120, can be used to control the pressure of the pump 255. In some scenarios, the valve 265 can be preset prior to deployment at test pressures that are relevant to the system.

In some implementations, the DWUTS 120 can further include flow meters 270 and pressure transducers 275 that can be operatively coupled to the pump 255. The flow meters 270 and the pressure transducers 275 can also be operatively coupled to the data logger 225, and can be configured to transmit measured signals to the data logger 225, the measured signals describing the flow and pressure parameters under which the pumps 255 operate. The data logger 225 can store the signals as data, which can be retrieved, for example, downloaded, when the DWUTS 120 is retrieved to the surface. Alternatively, or in addition, the data logger 225 can transmit the signals through the umbilical 118 to the HMI 230. In this manner, the data can be reviewed in real time as the tests are progressing and can also be downloaded when the DWUTS 120 is on the seabed 107. Responsive to the real-time review, the HMI 230 can be used to transmit instructions to regulate the operation of the pump 255 using, for example, the control valves 265. In some implementations, the umbilical 118 can include a fiber optic cable connecting the HMI 230 and the data logger 225, through which the logged data and the instructions can be transmitted. In this manner, a user of the HMI 230 can monitor the pressurization rate (of the umbilical 115, for example) and the volumes, in particular, and all the tests, in general.

In some implementations, the umbilical 118 can include multiple fiber-optic cables to transmit the logged data and the instructions.

In some implementations, the DWUTS 120 can include a fluid cleanliness analyzer 280 that can be operatively coupled to the pump 255. For example, the fluid cleanliness analyzer 280 can be incorporated into the pump discharge to check the fluid cleanliness prior to the fluid entering the umbilical 115. In some scenarios, the analyzer 280 can transmit the measured cleanliness of the pump discharge to the HMI 230. The HMI 230 can store a threshold cleanliness with which the HMI 230 can compare the cleanliness value transmitted by the analyzer 280. If the threshold is satisfied, then the HMI 230 can instruct the DWUTS 120 to fill the umbilical 115 with the test fluid. For example, the threshold value can be standard cleanliness values.

In some implementations, a flow restricting device 285 and a control unit 290 can regulate the flow of fluids into the umbilicals 115, 160, 165 and 170. For example, the control unit 290 can operate the flow restricting device 285 to regulate the fluid that flows into the umbilicals through the test lead 117. The control unit 290 and the HMI 230 can be operatively coupled to receive and transmit signals to each other, for example, through fiber-optic cables included in the umbilical 117. The fluids in the umbilicals can be released after completion of the pressure test. To do so, in some implementations, the HMI 230 can transmit instructions to the control unit 290 based upon which the control unit 290 can operate the flow restricting device 285 to release the pressure fluids from the umbilicals. In some implementations, the pressurized fluid can be released into a separate sea water compensated tank 295. The tank 295 can be included in the DWUTS 120 or on the manifold 125 or can be located separately.

Figure 4:
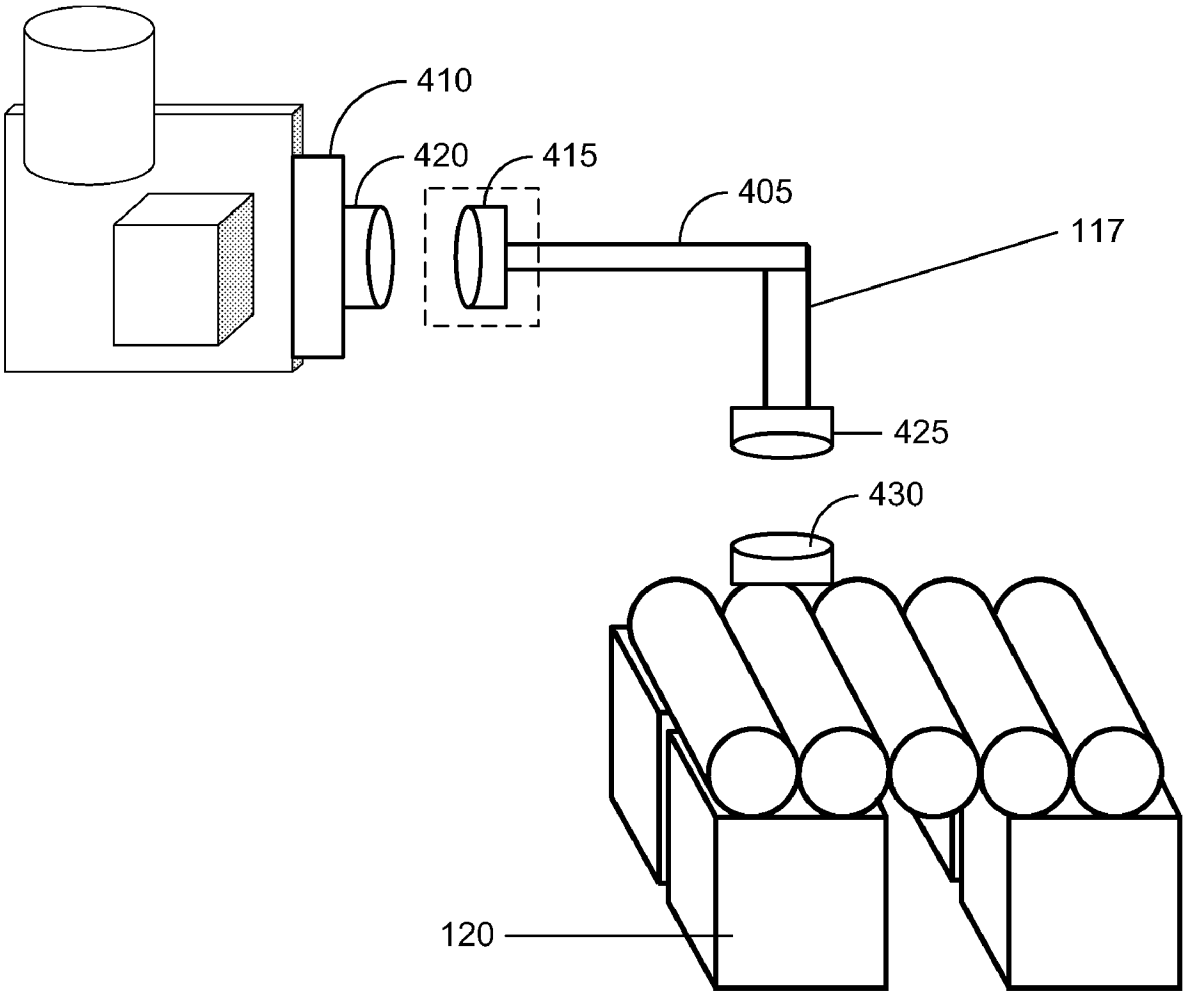
FIG. 4 is a schematic diagram showing a coupling between a test leads and a SUTA.

FIG. 4 is a schematic diagram showing a coupling between test leads 405 and a SUTA 410. In some implementations, the test leads 405 can be connected to a termination plate 415 that matches a termination plate 420 fitted to the SUTA 410. In some implementations, the test leads 405 can include a lead 425, for example, a detachable lead, that includes the optical fibers and additionally power and communication cables made from copper cores, for example. The lead or leads can connect all the testing apparatus to a communications box 430 installed, for example, in the data logger 225. Alternatively, the communications box 430 can be installed anywhere in the DWUTS 120. The communications box 430 can be operatively coupled to the HMI 230 using techniques, for example, similar to those described previously. In some implementations, power to the testing units, for example, the electrical testing unit 215, the optical fiber test unit 220, and the like, can be delivered through copper power conductors in the leads described above.

Figure 5:
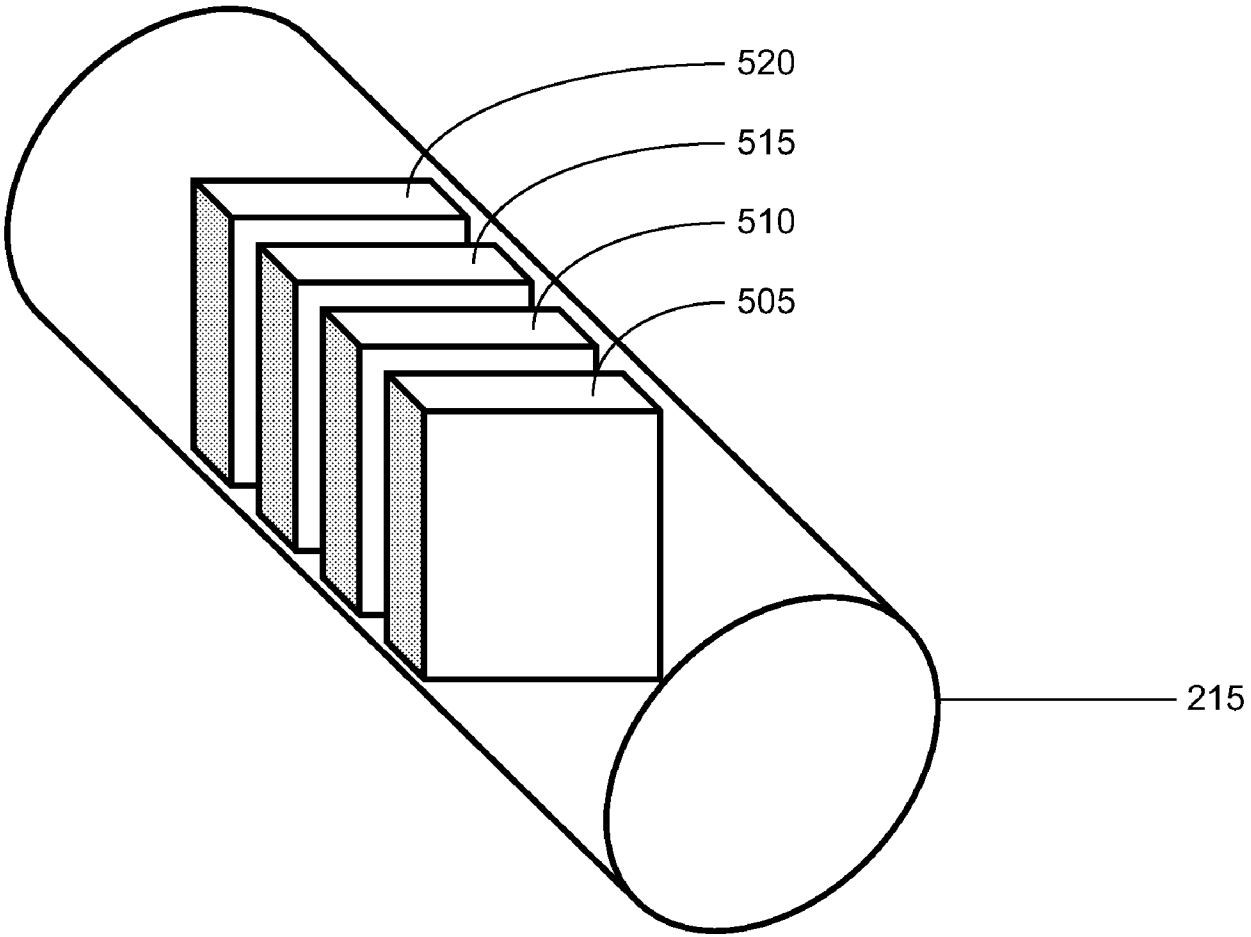
FIG. 5 is a schematic diagram showing the multiple components included in an electrical testing unit.

FIG. 5 is a schematic diagram showing the multiple components included in an electrical testing unit 215. The test units installed on the DWUTS 120 can be configured to perform one or more of the electrical tests and the optical tests. The electrical test unit 215 can include insulation resistance testers (Megaohmmeters) 505 that can perform IR tests. In some implementations, the resistance testers 505 can be battery driven and remote operated, for example, using instructions from the HMI 230. An example of an insulation tester 505 is a Megger S1 5010. It will be appreciated that other types of insulation testers 505 can also be used. The electrical test unit 215 of the DWUTS 120 can include a switching unit for switching the testing instruments of the unit 215 between multiple electrical lines of an umbilical, enabling a given electrical test unit to test multiple electrical lines.

In some implementations, the electrical test unit 215 can include CR testers (ohmmeters) 510 that can perform CR tests. The CR testers 510 can be battery driven and remote operated, for example, using instructions from the HMI 230. An example of a CR tester 510 is a XiTRON XT560. Other types of CR testers 510 can also be used.

In some implementations, the electrical test unit 215 can further include a time domain reflectometer 515, which can be remotely battery driven. An example of a time domain reflectometer 515 is a Digiflex COM. Further, the optical fiber test unit 220 can include an optical time domain reflectometer 520, for example, a remotely battery operated JDSU 6000. In some implementations, the optical time domain reflectometer 520 can test single mode fibers at several wavelengths, for example, 1310 nm and 1550 nm. Alternatively, or in addition, the reflectometer 520 can be configured to perform multi-mode fiber testing, for example, by replacing the single mode module with a multi-mode fiber module. In other implementations, the multi-mode module can be located within the housing of the reflectometer 520 and can include a switch allowing switching between modes. It will be appreciated that multiple testers can be installed in the electrical test unit 215. Alternatively, or in addition, the testers can be installed at several positions in the DWUTS 120. The optical test unit 220 of the DWUTS 120 can include a switching unit for switching the instruments of the unit 220 between multiple optical fibers, enabling a given optical test unit to test multiple optical fibers.

The electrical test unit 215, and the units described with reference to FIG. 2, can be operatively coupled to the SUTA, for example, using a common test lead for testing the electrical power and communications conductors. In some implementations, the electrical test unit 215 can be operatively coupled to the HMI 230 through a relay and PLC system which can include multiple lead pins. For example, the relay system can be connected to the communications box of the DWUTS 120 allowing communications with the HMI 230 on the top side. One or more of the lead pins connect the HMI 230 to a corresponding test unit on the DWUTS 120. A user of the HMI 230 can transmit instructions to the one or more lead pins to operate a particular test unit to perform tests. In some scenarios, the electrical test unit 215 can be connected to the common test lead using a twelve pin bulk head connector that is installed on the housing of the electrical test unit 215. The optical fiber test unit 220 can be connected to the HMI 230 in a manner similar to the electrical test unit 215. In some scenarios, an eight fiber connector and flying lead with an end that is suitable for the SUTA 410 can be used to connect the optical fiber test unit 220 and the SUTA 410.

Figure 6:
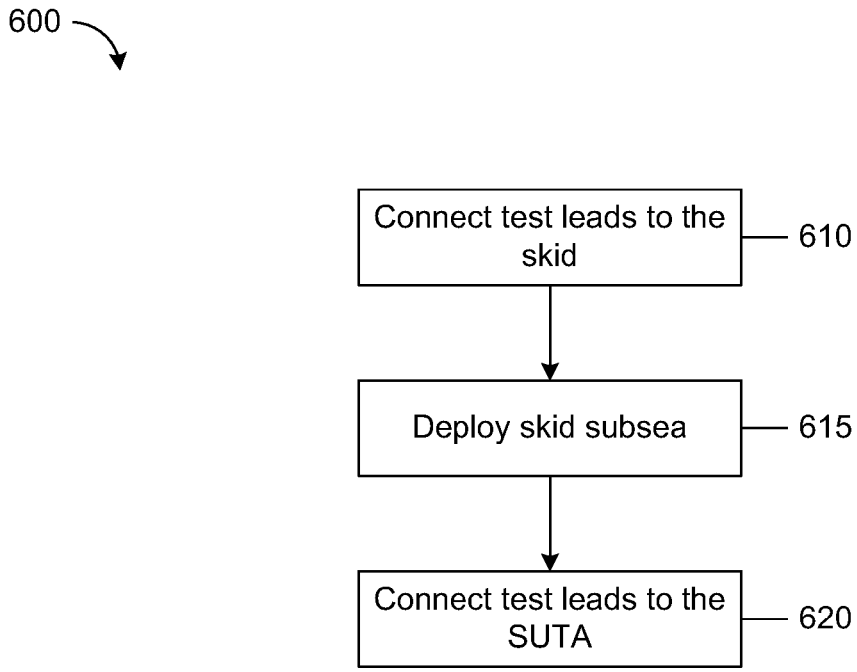
FIG. 6 is a flowchart showing a process of deploying the DWUTS.

FIG. 6 is a flowchart showing a process 600 of deploying the DWUTS 120. The process 600 connects leads to the skid (step 610). For example, the test leads include an electrical test lead and a fiber optic test lead. The leads can be connected to the skid prior to deployment or when the skid is on the sea bead, for example, by an ROV. The process 600 deploys the skid subsea (step 615). For example, the DWUTS 120 can be lowered to the seabed 107 by a crane or carried by an ROV. The process 600 connects the test leads to the SUTA (step 620). For example, the other ends of the test leads are connected to the SUTA either by an ROV or a diver depending upon the depth.

Figure 7:
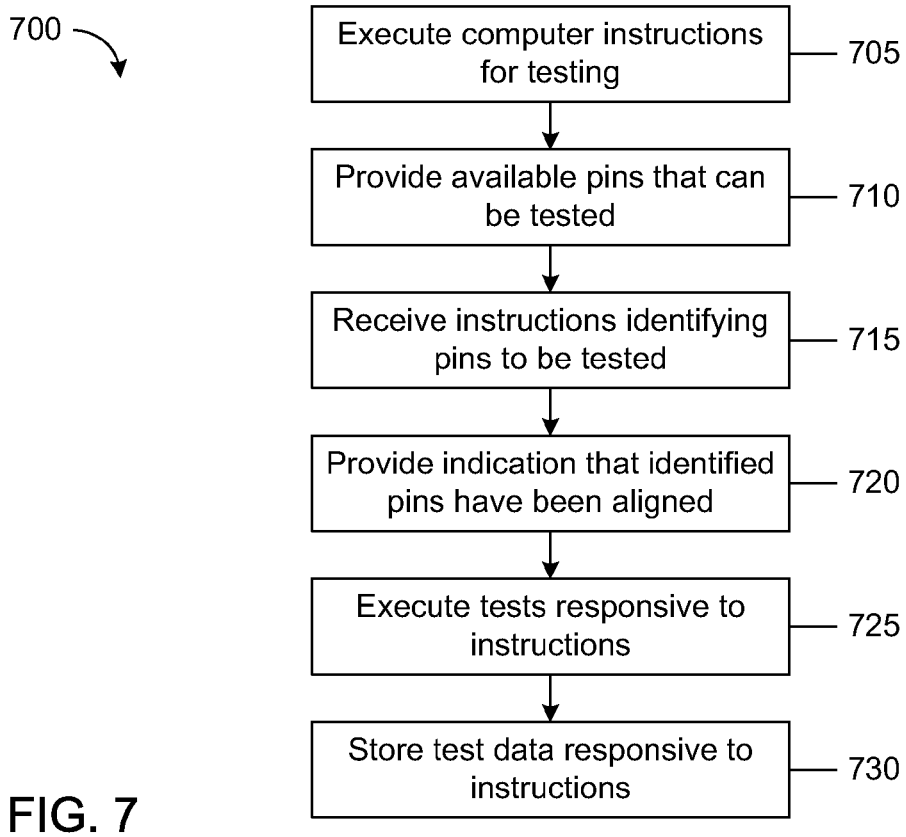
FIG. 7 is a flowchart showing a process of testing.

FIG. 7 is a flowchart showing a process 700 of testing. The process 700 executes computer instructions for testing (step 705). For example, the HMI 230 executes a software program that includes computer software instructions executable by one or more computers for testing the test units. The process 700 provides the available pins that can be tested (step 710). The process 700 receives instructions identifying the pins to be tested (step 715). For example, a user of the HMI 230 can set the relay system to the correct pins for the testing units to test. The process 700 provides indication that the identified pins have been aligned (step 720). For example, the HMI 230 can provide an indication on a user interface indicating that the pins have been aligned. Alternatively, the HMI 230 can be operatively coupled to a device that is external to the HMI 230 to provide an indication of alignment. The process 700 executes tests responsive to instructions (step 725). The process 700 stores test data responsive to instructions (step 730). For example, the test data can be stored on a storage device, for example, a USB storage device.

Implementations of the HMI 230 can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results.

Thus, particular implementations of the subject matter have been described. Other implementations are within the scope of the following claims. For example, the DWUTS 120 can be used, without being coupled to an ROV, to monitor the assembly of umbilicals and associated systems during lay operations.

What is claimed is:

1. A method of testing a subsea control umbilical, comprising:

with an umbilical testing skid residing subsea and coupled to communicate hydraulically with the subsea control umbilical and at least one of electrically or optically with the subsea control umbilical, initiating at least one of electric or optical testing on the subsea control umbilical;

initiating hydraulic testing on the subsea control umbilical; and performing substantially the remainder of the hydraulic testing with the testing skid not coupled to an ROV.

2. The method of claim 1, wherein initiating hydraulic testing on the subsea control umbilical comprises hydraulically pressurizing the subsea control umbilical with fluid using the testing skid; and wherein performing substantially the remainder of the hydraulic testing with the testing skid not coupled to an ROV comprises monitoring pressure of the fluid within the subsea control umbilical with the testing skid not coupled to an ROV.

3. The method of claim 1, wherein the hydraulic testing on the subsea control umbilical is initiated with the testing skid not coupled to an ROV.

4. The method of claim 1, wherein at least one of electric or optical testing on the subsea control umbilical is initiated with the testing skid not coupled to an ROV.

5. The method of claim 1, further comprising, prior to performing at least a portion of the hydraulic testing with the testing skid not coupled to an ROV, uncoupling the ROV from the testing skid.

6. The method of claim 1, wherein the testing skid is coupled to the subsea control umbilical through a subsea umbilical termination assembly.

7. The method of claim 1, communicating at least one of power or control signals to the testing skid through a second umbilical.

8. The method of claim 1, wherein the electric testing comprises insulation resistance testing, conductor resistance testing, and time domain reflectometer testing.

9. The method of claim 1, wherein the optic testing comprises optical time domain reflectometer testing.

10. A system for testing a subsea control umbilical, comprising:

a test skid comprising:

a hydraulic testing unit for hydraulic testing the subsea control umbilical;

an electrical testing unit for performing electrical testing on the subsea control umbilical;

an optical fiber testing unit for performing optical fiber testing on the subsea control umbilical;

an umbilical coupling in communication with the hydraulic testing unit, the electrical testing unit, and the optical fiber testing unit for communicating, apart from an ROV, between the hydraulic testing unit, the electrical testing unit, and the optical fiber testing unit and a human machine interface; and a test lead coupling for coupling the hydraulic testing unit, the electrical testing unit, and the optical fiber testing unit to the subsea control umbilical being tested.

11. The system of claim 10, wherein the test skid is adapted to operate in performing the electrical testing and optical fiber testing apart from an ROV.

12. The system of claim 10, wherein the test skid is adapted to operate in performing at least a portion of the hydraulic testing apart from an ROV.

13. The system of claim 10, wherein the test skid is adapted to operate in performing the hydraulic testing apart from an ROV.

14. The system of claim 10, further comprising a second umbilical connected at the umbilical coupling and adapted to communicate power, data and control signals with the umbilical coupling of the test skid.

15. The system of claim 10, wherein the hydraulic testing unit is adapted to perform pressure testing on the subsea control umbilical.

16. The system of claim 10, wherein the electric testing unit is adapted to perform testing comprising insulation resistance testing, conductor resistance testing, and time domain reflectometer testing.

17. The system of claim 10, wherein the optical testing unit is adapted to perform testing comprising optical time domain reflectometer testing.

18. A method of testing a subsea control umbilical, comprising:

performing a first portion of testing on the subsea control umbilical, the testing comprising hydraulic testing and at least one of electrical or optical testing; and performing a second portion of the testing independent of a diver or an ROV.

19. The method of claim 18, wherein performing a first portion of the testing is performed independent of a diver or an ROV.

20. The method of claim 18, wherein the first portion of the testing comprises pressurizing the subsea control umbilical with fluid and wherein the second portion of the testing comprises measuring a pressure of the fluid.

* * * * *